US007956826B2

(12) United States Patent
Childs et al.

(10) Patent No.: US 7,956,826 B2
(45) Date of Patent: Jun. 7, 2011

(54) ELECTROLUMINESCENT DISPLAY DEVICE TO DISPLAY LOW BRIGHTNESS UNIFORMLY

(75) Inventors: Mark J. Childs, Sutton (GB); David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 596 days.

(21) Appl. No.: 10/523,381

(22) PCT Filed: Jul. 22, 2003

(86) PCT No.: PCT/IB03/03204

§ 371 (c)(1), (2), (4) Date: Nov. 21, 2005

(87) PCT Pub. No.: WO2004/015668

PCT Pub. Date: Feb. 19, 2004

(65) Prior Publication Data

US 2006/0114198 A1 Jun. 1, 2006

(30) Foreign Application Priority Data

Aug. 6, 2002 (GB) ..... 0218172.5

(51) Int. Cl.
*G09G 3/30* (2006.01)

(52) U.S. Cl. ..... 345/77; 345/78

(58) Field of Classification Search ..... 345/690, 345/82–83, 77; 315/169.3
See application file for complete search history.

(56) References Cited

U.S. PATENT DOCUMENTS

| | | | | |
|---|---|---|---|---|
| 4,353,062 | A | 10/1982 | Lorteije et al. | |
| 4,967,192 | A * | 10/1990 | Hirane et al. | 345/211 |
| 6,023,259 | A | 2/2000 | Howard et al. | |
| 6,094,243 | A | 7/2000 | Yasunishi | |
| 6,326,941 | B1 | 12/2001 | Yamazaki et al. | |
| 6,680,577 | B1 * | 1/2004 | Inukai et al. | 315/169.3 |
| 2002/0030647 | A1 * | 3/2002 | Hack et al. | 345/82 |

FOREIGN PATENT DOCUMENTS

| | | | |
|---|---|---|---|
| EP | 0717446 | A1 | 6/1996 |
| WO | WO9636959 | A1 | 11/1996 |

* cited by examiner

*Primary Examiner* — Kevin M Nguyen

(57) ABSTRACT

An electroluminescent (EL) display device has current-driven pixels and is operable in at least two phases within each frame period. In one phase, one of a first plurality (31) of analogue drive currents can be driven through EL display element. In another longer phase, one of a second plurality (33) of analogue drive currents is independently driven through the EL display element. This device combines a time ratio method with an analogue drive scheme. A shorter phase may provide the higher resolution (smaller) increments and one longer phase may provide lower resolution (larger) increments. Low brightness outputs can be achieved with a higher drive current, but over a short duration, which reduces non-uniformity in the pixel output.

20 Claims, 5 Drawing Sheets

ELECTROLUMINESCENT DISPLAY DEVICE TO DISPLAY LOW BRIGHTNESS UNIFORMLY

The invention relates to electroluminescent display devices, for example using organic LED devices such as polymer LEDs.

Matrix display devices employing electroluminescent, light-emitting, display elements are well known. The display elements may comprise organic thin film electroluminescent elements, for example using polymer materials, or else light emitting diodes (LEDs) using traditional III-V semiconductor compounds. Recent developments in organic electroluminescent materials, particularly polymer materials, have demonstrated their ability to be used practically for video display devices. These materials typically comprise one or more layers of a semiconducting conjugated polymer sandwiched between a pair of electrodes, one of which is transparent and the other of which is of a material suitable for injecting holes or electrons into the polymer layer. The polymer material can be fabricated using a CVD process, or simply by a spin coating technique using a solution of a soluble conjugated polymer. Ink-jet printing may also be used. Organic electroluminescent materials exhibit diode-like I-V properties, so that they are capable of providing both a display function and a switching function, and can therefore be used in passive type displays. Alternatively, these materials may be used for active matrix display devices, with each pixel comprising a display element and a switching device for controlling the current through the display element.

Display devices of this type have current-addressed display elements. As a result, drive schemes used in the more mature technology of liquid crystal displays are typically not appropriate for electroluminescent displays. A conventional, analogue drive scheme for electroluminescent displays involves supplying a controllable current to the display element. It is known to provide a current source transistor as part of the pixel configuration, with the gate voltage supplied to the current source transistor determining the current through the display element. A storage capacitor holds the gate voltage after the addressing phase. However, different transistor characteristics across the substrate give rise to different relationships between the gate voltage and the source-drain current, and artefacts in the displayed image result.

Particularly at low brightness levels, these displays suffer non-uniformity.

Digital drive schemes have also been proposed. In such schemes, the LED device is effectively driven to two possible voltage levels. This overcomes the non-uniformity problem, as the pixels are no longer driven to low brightness levels. This also reduces the power consumption in the pixel circuit, because a transistor is no longer required to operate in the linear region as a current source. Instead, all transistors can be fully on or fully off, which reduces power consumption. Such a drive scheme is less sensitive to transistor characteristic variations for the same reason. This approach only gives two possible pixel outputs. However, grey scale pixel outputs can be achieved by a number of methods.

In one approach, pixels can be grouped to form larger pixels. Pixels within the group can be addressed independently, so that a grey scale is produced which is a function of the number of pixels within the group activated. This is known as an area ratio method. A drawback of this approach is the reduced resolution of the display and the increased pixel complexity.

In an alternative approach, pixels can be turned on and off more quickly than the frame rate, so that a grey scale is implemented as function of the duty cycle with which the pixel is turned on. This is known as a time ratio method. For example, a frame period may be divided into sub-frame periods in the ratio 1:2:4 (giving 8 evenly spaced grey scale values). This increases the required driving capability (or else requires a reduction in the frame rate), and therefore increases the cost of the display.

According to a first aspect of the invention, there is provided an electroluminescent (EL) display device comprising an array of display pixels, each display pixel comprising an EL display element and a current source circuit for driving a current through the EL display element in dependence on a data voltage, wherein the display device is operable in at least first and second phases within each frame period:

the first phase having a first duration and during which a first one of a first plurality of analogue drive currents can be driven through EL display element; and the second phase having a second duration, different to the first duration, and during which a second one of a second plurality of analogue drive currents can be driven through EL display element, wherein the first and second ones of the plurality of analogue drive currents are independently selectable.

This device combines a time ratio method with an analogue drive scheme. During the different phases (two or more) the pixel may be driven to one of a number of analogue levels. Thus, one shorter phase may provide the higher resolution (smaller) increments and one longer phase may provide lower resolution (larger) increments. The combined output can then provide many more levels than the number of analogue drive levels. In turn, the lower brightness outputs can be achieved with a higher drive current, but over a short duration.

The plurality of analogue drive levels can comprises a number n of drive levels, and wherein the duration of one phase is approximately n times the duration of the other phase.

In one embodiment, the first plurality of analogue drive currents is the same as the second plurality of analogue drive currents. In each phase, n levels (including zero) can then be combined to provide $n^2$ analogue levels. For example 8 analogue levels (including zero) can be used to provide 6 bit (64 level) resolution. The lowest current drive level is then 1/7 of the highest current drive level.

In another embodiment, the first plurality of analogue drive currents comprises a first number n of drive current levels for providing the lowest n brightness levels (including zero), and the second plurality of analogue drive currents comprises a second number m of non-zero drive current levels for providing the highest m brightness levels, where n+m is the total number of brightness levels. In this case, the shorter phase is used only for the first, lowest brightness levels. For the higher brightness levels, only the second phase is used. The number of levels m to which the pixel can be driven in the second phase is then higher than the number of levels n to which the pixel can be driven in the first phase. For example n can be 8 to provide the lowest 8 levels (0 to 7), and the 8th to 63rd levels can be provided by driving the pixels to one of 56 different levels in the second phase.

Each pixel can comprise a drive transistor, a storage capacitor for storing a gate voltage of the drive transistor and an address transistor for switching a data voltage to the gate of the drive transistor during an addressing phase. Thus, a conventional voltage addressed current source pixel can be used to implement the invention.

The display device of the invention may be used in a portable device, such as a mobile phone.

The invention also provides a method of driving an electroluminescent (EL) display device comprising an array of display pixels, each display pixel comprising an EL display element and a current source circuit for driving a current through the EL display voltage in dependence on a data voltage, the method comprising:

in a first phase having a first duration, driving a first one of a first plurality of analogue drive currents through EL display element; and in a second phase having a second duration, different to the first duration, driving a second one of a second plurality of analogue drive currents through EL display element, wherein the first and second ones of the plurality of analogue drive currents are selected to provide a desired combined EL display element output.

Embodiments of display devices in accordance with the invention will now be described, by way of example, with reference to the accompanying drawings, in which.

Figure 1:
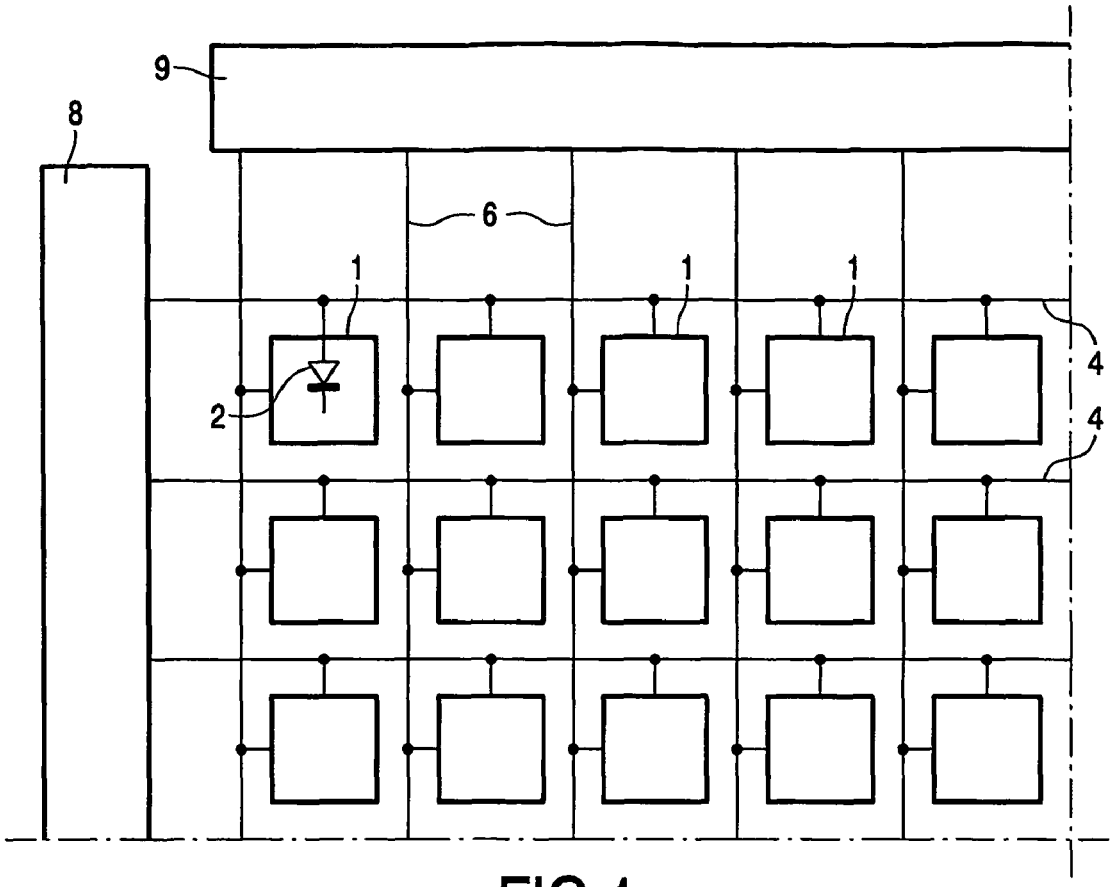
FIG. 1 shows the layout of a conventional EL display device.

Referring to FIG. 1, an active matrix addressed electroluminescent display device comprises a panel having a row and column matrix array of regularly-spaced pixels, denoted by the blocks 1 and comprising electroluminescent display elements 2 together with associated switching means, located at the intersections between crossing sets of row (selection) and column (data) address conductors 4 and 6. Only a few pixels are shown in the FIGURE for simplicity. In practice there may be several hundred rows and columns of pixels. The pixels 1 are addressed via the sets of row and column address conductors by a peripheral drive circuit comprising a row, scanning, driver circuit 8 and a column, data, driver circuit 9 connected to the ends of the respective sets of conductors.

The electroluminescent display element 2 comprises an organic light emitting diode, represented here as a diode element (LED) and comprising a pair of electrodes between which one or more active layers of organic electroluminescent material is sandwiched. The display elements of the array are carried together with the associated active matrix circuitry on one side of an insulating support. Either the cathodes or the anodes of the display elements are formed of transparent conductive material. The support is of transparent material such as glass and the electrodes of the display elements 2 closest to the substrate may consist of a transparent conductive material such as ITO so that light generated by the electroluminescent layer is transmitted through these electrodes and the support so as to be visible to a viewer at the other side of the support. Typically, the thickness of the organic electroluminescent material layer is between 100 nm and 200 nm. Typical examples of suitable organic electroluminescent materials which can be used for the elements 2 are known and described in EP-A-0717446. Conjugated polymer materials as described in WO96/36959 can also be used.

Figure 2:
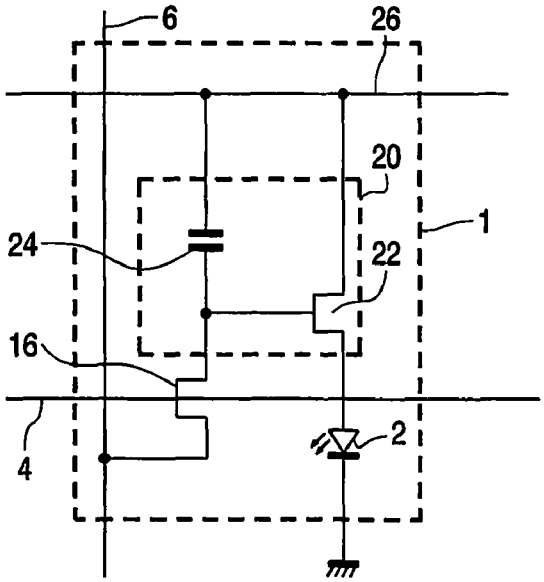
FIG. 2 is a simplified schematic diagram of a known pixel circuit for current-addressing an EL display pixel.

FIG. 2 shows in simplified schematic form a known pixel and drive circuitry arrangement. Each pixel 1 comprises the EL display element 2 and associated driver circuitry. The driver circuitry has an address transistor 16 which is turned on by a row address pulse on the row conductor 4. When the address transistor 16 is turned on, a voltage on the column conductor 6 can pass to the remainder of the pixel. In particular, the address transistor 16 supplies the column conductor voltage to a current source 20, which comprises a drive transistor 22 and a storage capacitor 24. The column voltage is provided to the gate of the drive transistor 22, and the gate is held at this voltage by the storage capacitor 24 even after the row address pulse has ended.

The drive transistor 22 is a PMOS device, and the circuit is formed using low temperature polysilicon (LTPS). The transistor characteristics of LTPS transistors are non-uniform, and the effect of this non-uniformity is to make the current source operation of the pixel circuit non-uniform. As the brightness of the LED is dependent on the current, the display is non-uniform in brightness.

There are proposals to use current addressed pixels, in which the pixel circuit includes a current mirror circuit for sampling a drive current. However, this increases the pixel complexity, and it can be preferable to resolve the uniformity problem whilst retaining voltage addressed pixels.

These voltage addressed pixels tend to be non-uniform at low pixel currents but tend to be acceptable at higher current.

The invention provides a drive scheme by which the pixel is driven only at high currents, but which maintains a large number of analogue drive levels, for example meeting the 6 bit per pixel standard.

Figure 3:
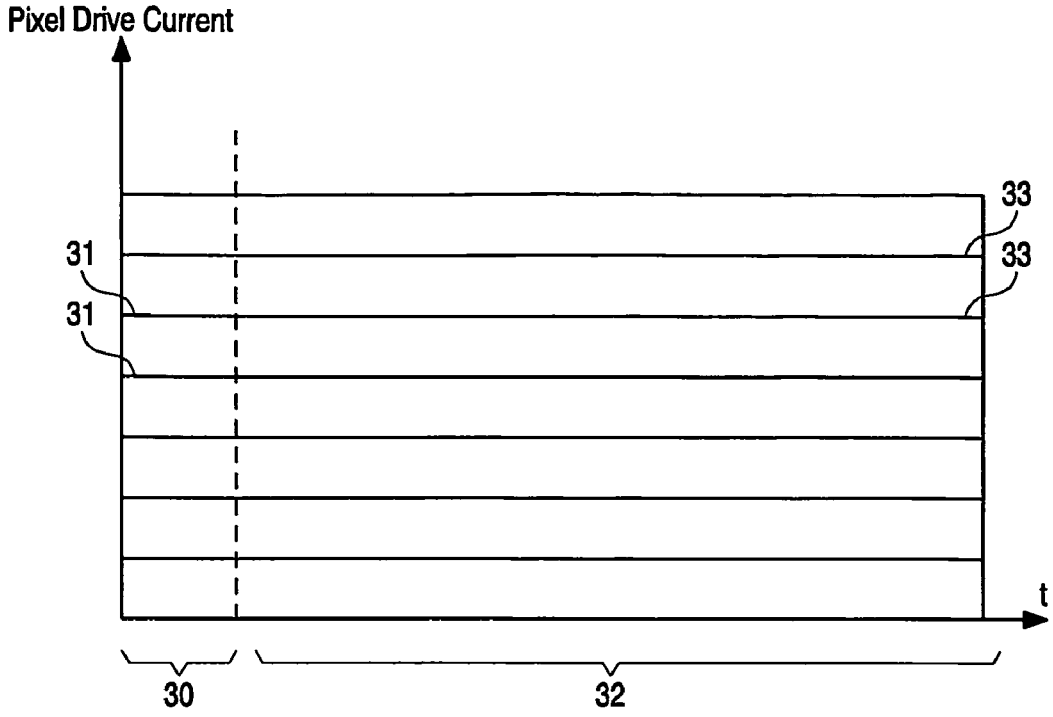
FIG. 3 shows the possible drive levels in different phases of the drive scheme of a first embodiment of the invention.

FIG. 3 shows the possible drive levels in a first drive scheme of the invention. The frame period is divided into two phases 30,32. This requires all pixels to be addressed twice within each frame. For example, all pixels can be addressed once, row by row at the beginning of the first phase 30, the full pixel array then needs to be addressed in time for the beginning of the second phase 32, when all pixels are re-addressed in the same row by row order.

This may impose a shorter available row address period, but this may not be a problem for small displays (having less rows) for example for portable products, or where the frame rate can be lower, again for example for portable equipment.

The first phase 30 has a relatively short duration, and one of 8 analogue drive current levels 31 can be driven through EL display element (including zero) in this phase. As a result of the short duration, these 8 levels provide the 8 lowest brightness levels (i.e. levels 0 to 7).

The second phase 32 has a relative long duration, in particular 8 times longer than the duration of the first phase. In the example of FIG. 3, the same 8 analogue drive current levels 33 can be driven through EL display element, so that the second phase 32 provides brightness levels 0, 8, 16, 24, 32, 40, 48 and 56. The levels for the first and second phases are independently selectable, so that addition of the brightness outputs from the two phases enables all 64 levels to be achieved.

Figure 4:
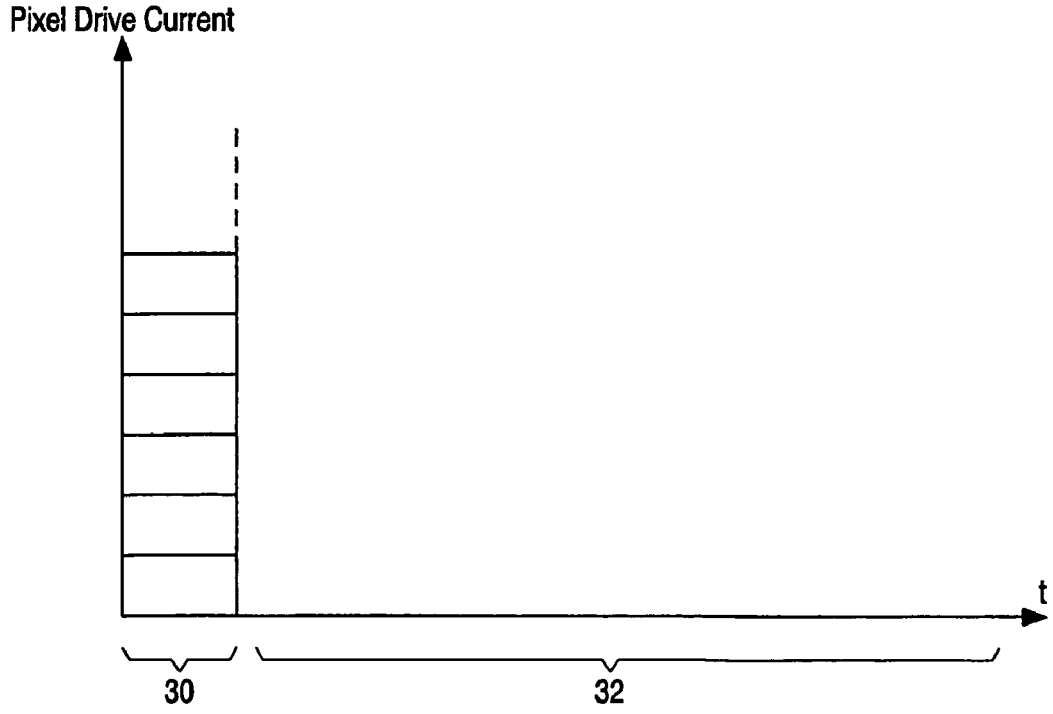
FIG. 4 shows how the levels of FIG. 3 are used to provide a display of the 6th brightness level.

FIG. 4 shows how the levels of FIG. 3 are used to provide a display of the 6th brightness level. In this case, the pixel is driven to the 6th level in the first phase and is off in the second phase.

Figure 5:
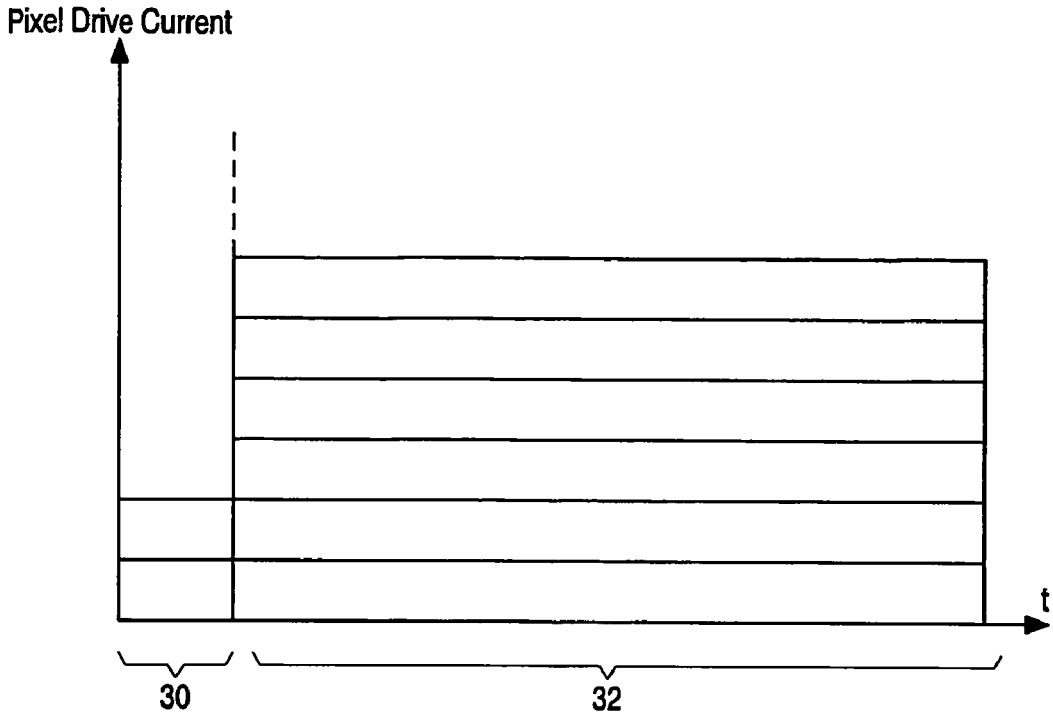
FIG. 5 shows how the levels of FIG. 3 are used to provide a display of the 50th brightness level.

FIG. 5 shows how the levels of FIG. 3 are used to provide a display of the 50th brightness level. In this case, the pixel is driven to the 2nd level in the first phase and is driven to the 6th level in the second phase.

Figure 6:
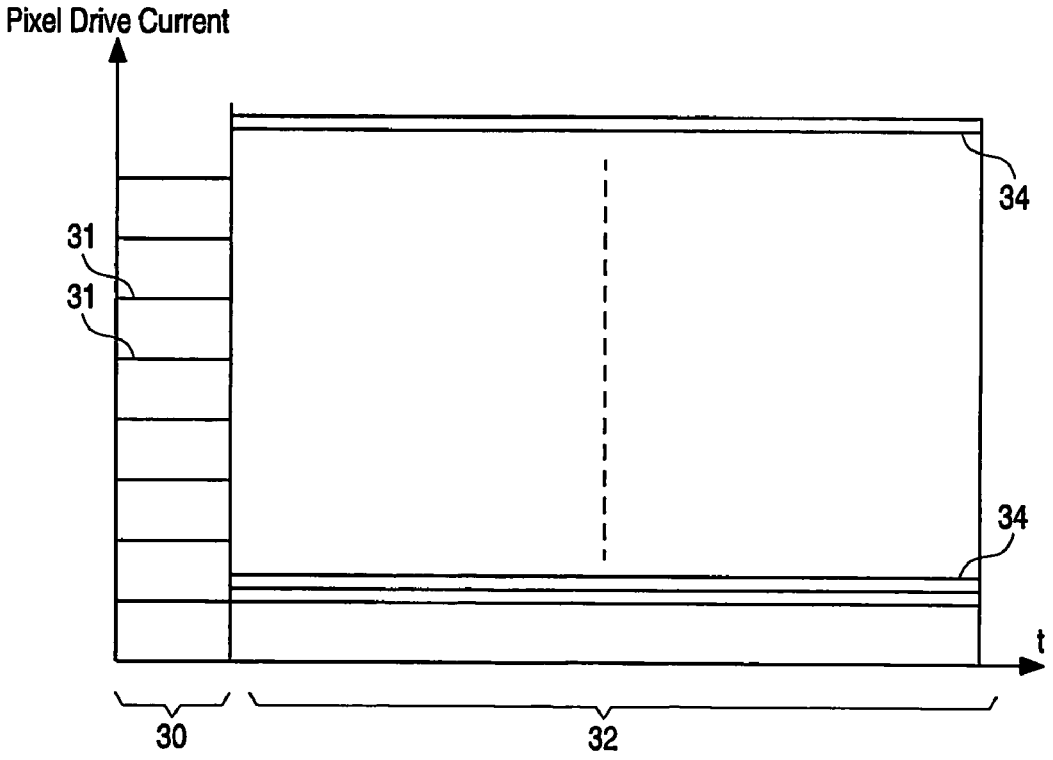
FIG. 6 shows the possible drive levels in different phases of the drive scheme of a second embodiment of the invention.

FIG. 6 shows the possible drive levels in different phases for a second this drive scheme of the invention. In this embodiment, the levels 31 to which pixels are driven in the first phase 30 provide the lowest n brightness levels, but the second phase 32 uses a different greater number of drive current levels 34 for providing (alone) the remaining brightness levels.

For example, the first phase can again have 8 levels to provide the lowest 8 levels (including zero), and the 8th to 63rd levels can be provided by driving the pixels to one of 56 different levels 34 in the second phase. For this purpose, the second phase is again 8 times longer than the first phase. To provide the highest level (63), the peak drive current in the second phase is higher as shown in FIG. 6, so that the average current is equal to the peak drive current in the first phase 30 despite the first phase being turned off. The peak current in the second phase (using a normalised scale) needs to be 63/8 (7.875).

Figure 7:
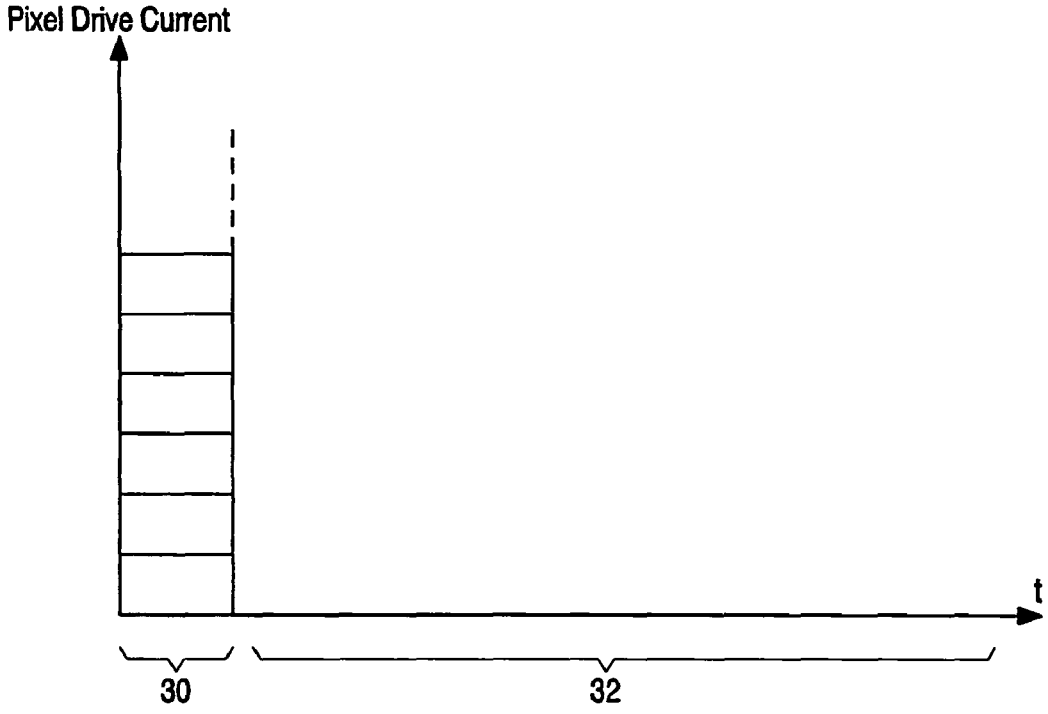
FIG. 7 shows how the levels of FIG. 6 are used to provide a display of the 6th brightness level.
Figure 8:
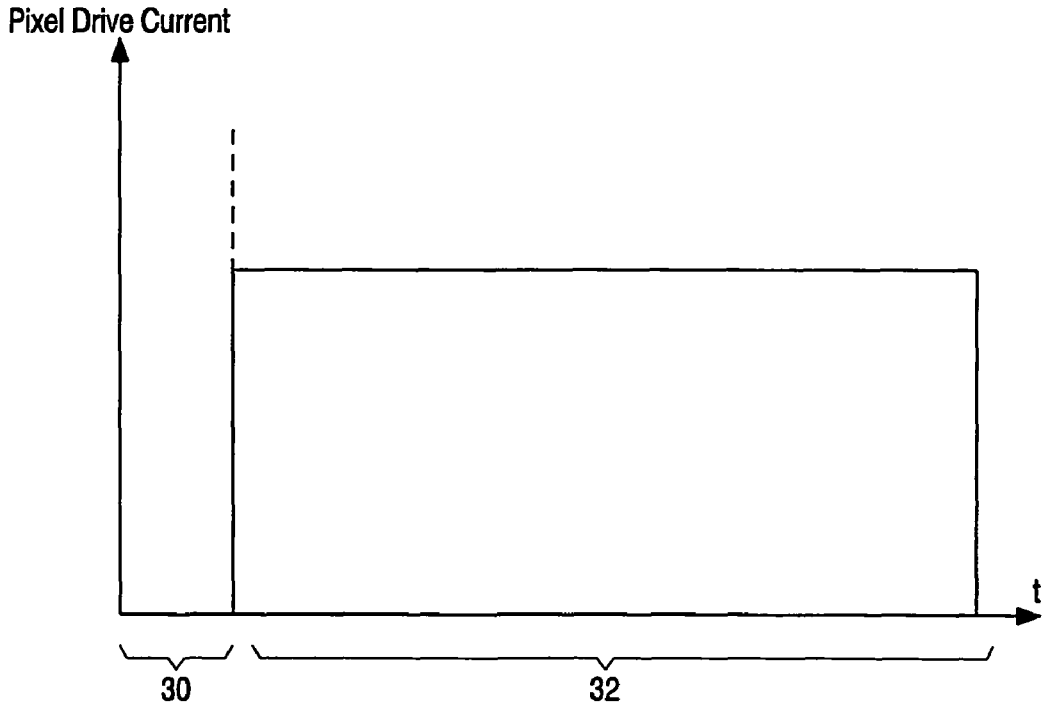
FIG. 8 shows how the levels of FIG. 3 are used to provide a display of the 50th brightness level.

FIG. 7 shows how the levels of FIG. 6 are used to provide a display of the 6th brightness level. This is achieved using only the first phase 30. FIG. 8 shows how the levels of FIG. 3 are used to provide a display of the 50th brightness level. In this case, only the second phase is used, and is driven to a level of 50/8.

Figure 9:
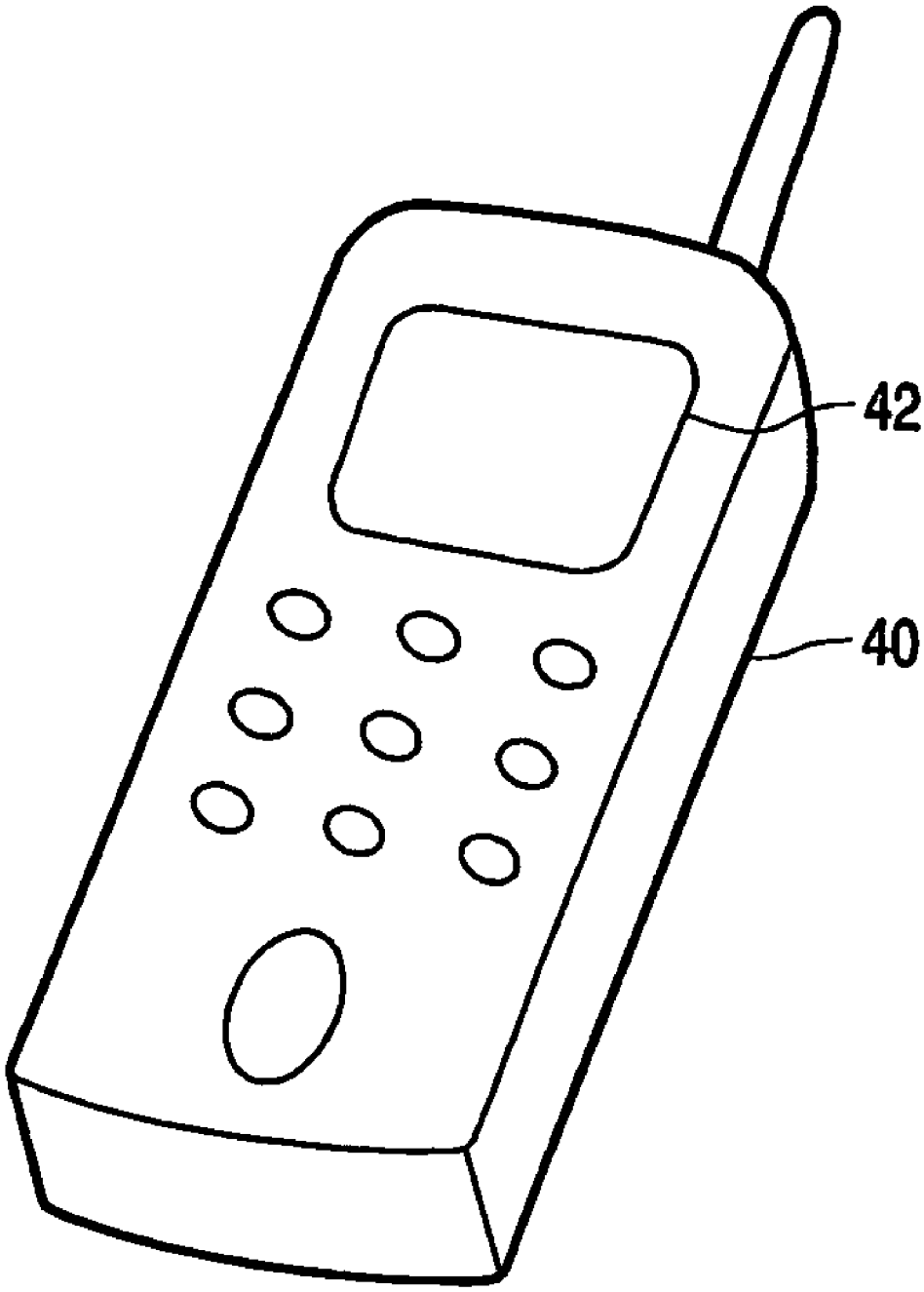
FIG. 9 shows a mobile telephone 40 incorporating a display 42 of the invention.

As mentioned above, the display device of the invention may be used in a portable device, such as a mobile phone. FIG. 9 shows a mobile telephone 40 incorporating a display 42 of the invention.

The pixel circuits described above are only examples of possible pixel structures which can be improved by the invention. In particular, any pixel design for providing a fixed voltage to the EL display element can be improved using the teaching of the invention in order to increase the minimum drive current. This may be accompanied by a reduction in the number of drive levels, or this may not be desired. The required driver circuits for providing the closely spaced voltage drive levels are readily available.

Specific examples have been given above with two phases, and with 7 voltage levels in the first phase. However, there may be more than two phases, scaling in duration in an exponential manner (for example 1:4:16 . . . or 1:3:9 . . . ). In such cases, the number of levels scales accordingly. The further the number of levels is reduced in the first phase, the smaller the difference between the highest and lowest drive current, thereby reducing the non-uniformity effect. However, an essentially analogue drive scheme is maintained so that multiple level (for example 6 bit) resolution is easily obtained. In the examples above, the lowest drive current is $1/7$ (FIG. 3) and $1/7.875$ (FIG. 6) of the peak drive current.

From reading the present disclosure, other modifications will be apparent to persons skilled in the art. Such modifications may involve other features which are already known in the field of matrix electroluminescent displays and component parts thereof and which may be used instead of or in addition to features already described herein.

The invention claimed is:

1. An electroluminescent (EL) display device comprising an array of display pixels, each display pixel comprising an EL display element and a current source circuit for driving a current through the EL display element in dependence on a data voltage, the display device being operable in at least a first and a second phase within each frame period, the first phase having a first duration and during which a first one of a first plurality of drive currents can be driven through the EL display element, and the second phase having a second duration, different to the first duration, and during which a second one of a second plurality of drive currents can be driven through the EL display element, wherein the first and second ones of the respective pluralities of drive currents are independently selectable and at least one of the first and second pluralities of drive currents include more than two drive current levels, and wherein the first plurality of drive currents comprises a number n of drive current levels, including a zero drive level, and wherein a duration of the second phase is approximately n times a duration of the first phase, wherein during said first phase each of the pixel display elements is sequentially driven for said first duration with a corresponding one of said first plurality of drive currents and during said second phase each of the pixel display elements is sequentially driven for said second duration with a corresponding one of said second plurality of drive currents associated with said second phase.

2. A device as claimed in claim 1, wherein n is 8.

3. A device as claimed in claim 1, wherein the first plurality of drive currents is the same as the second plurality of drive currents.

4. A device as claimed in claim 1, wherein the first plurality of drive currents comprises a first number n of drive current levels for providing the lowest n non-zero brightness levels, and the second plurality of drive currents comprises a second number m of non-zero drive current levels for providing the highest m brightness levels, where n+m is the total number of brightness levels.

5. A device as claimed in claim 1, wherein each pixel comprises a drive transistor, a storage capacitor for storing a gate voltage of the drive transistor and an address transistor for switching a data voltage to the gate of the drive transistor during an addressing phase.

6. A portable electronic device comprising a display device as claimed in claim 1.

7. A device as claimed in claim 1, wherein the first plurality of drive currents is the same as the second plurality of drive currents.

8. A device as claimed in claim 1, wherein each pixel comprises a drive transistor, a storage capacitor for storing a gate voltage of the drive transistor and an address transistor for switching a data voltage to the gate of the drive transistor during an addressing phase.

9. The EL display device of claim 1, wherein only the first phase is used to provide lowest n brightness levels.

10. The EL display device of claim 9, wherein only the second phase is used to provide brightness levels higher than the lowest n brightness levels.

11. The EL display device of claim 1, wherein the first phase is used for higher resolution and the second phase is used for lower resolution.

12. The EL display device of claim 1, wherein a highest brightness level is provided by turning off drive currents during the first phase, and increasing a peak drive current in the second phase to a higher level than an allowable peak drive current in the first phase.

13. The EL display device of claim 1, wherein all the display pixels are addressed twice within each frame period.

14. The EL display device of claim 1, wherein all the display pixels are addressed once row by row during the first phase, and are re-addressed in a same row by row order during the second phase.

15. A method of driving an electroluminescent (EL) display device comprising an array of display pixels, each display pixel comprising an EL display element and a current source circuit for driving a current through the EL display voltage in dependence on a data voltage, the method comprising the acts of:

in a first phase having a first duration, sequentially driving each of said display pixels with a corresponding one of a first plurality of drive currents for said first duration; and in a second phase having a second duration, different to the first duration, sequentially driving each of said display pixels with a corresponding one of a second plurality of drive currents for said second duration, wherein the first and second ones of the plurality of drive currents are selected to provide a desired combined EL display element output, and at least one of the first and second pluralities of drive currents includes more than two drive current levels, and wherein the plurality of drive currents comprises a number n of drive levels, and wherein a duration of the second phase is approximately n times a duration of the first phase.

16. A method as claimed in claim 15, wherein n is 8.

17. A method as claimed in claim 15, wherein the first plurality of drive currents is the same as the second plurality of drive currents.

18. A method as claimed in claim 15, wherein the first plurality of drive currents comprises a first number n of non-zero drive current levels for providing the lowest n brightness levels excluding zero, and the second plurality of drive currents comprises a second number m of non-zero drive current levels for providing the highest m brightness levels, where n+m is the total number of non-zero brightness levels.

19. The method of claim 15, further comprising the acts of:

using only the first phase to provide lowest n brightness levels; and using only the second phase to provide brightness levels higher than the lowest n brightness levels.

20. The method of claim 19, further comprising the act of providing a highest brightness level by turning off drive currents during the first phase, and increasing a peak drive current in the second phase to a higher level than an allowable peak drive current in the first phase.

* * * * *